US007509960B2

(12) United States Patent
Draghetti et al.

(10) Patent No.: US 7,509,960 B2
(45) Date of Patent: Mar. 31, 2009

(54) AUTOMATIC MACHINE FOR PROCESSING TOBACCO ARTICLES

(75) Inventors: Fiorenzo Draghetti, Medicina (IT); Mauro Falchieri, Monteveglio (IT)

(73) Assignee: D Societa' per Azioni, Bologna (IT)

( * ) Notice: Subject to any disclaimer, the term of this patent is extended or adjusted under 35 U.S.C. 154(b) by 663 days.

(21) Appl. No.: 10/991,330

(22) Filed: Nov. 17, 2004

(65) Prior Publication Data

US 2005/0150506 A1 Jul. 14, 2005

(30) Foreign Application Priority Data

Nov. 21, 2003 (IT) ..... BO2003A0704

(51) Int. Cl.
*A24C 5/32* (2006.01)

(52) U.S. Cl. ..... 131/281; 131/283

(58) Field of Classification Search ..... 131/280, 131/283; 181/200, 224

See application file for complete search history.

(56) References Cited

U.S. PATENT DOCUMENTS

| | | | | |
|---|---|---|---|---|
| 3,866,708 | A * | 2/1975 | Rudszinat et al. | 181/209 |
| 3,901,349 | A * | 8/1975 | DeNoyer | 181/200 |
| 4,129,264 | A * | 12/1978 | Lanin et al. | 241/285.1 |
| 4,671,299 | A | 6/1987 | Okumoto et al. | |
| 5,014,814 | A * | 5/1991 | Focke et al. | 181/200 |
| 6,431,310 | B1 * | 8/2002 | Heitmann | 181/200 |
| 6,668,837 | B1 | 12/2003 | Heitmann | |

FOREIGN PATENT DOCUMENTS

| | | |
|---|---|---|
| EP | 0 959 008 | 11/1999 |
| EP | 1 082 915 | 3/2001 |
| EP | 1 422 145 | 5/2004 |
| GB | 1 442 751 | 7/1976 |

OTHER PUBLICATIONS

English Abstract of EP 1 422 145 dated May 26, 2004.
English Abstract of EP 1 082 915 dated Mar. 14, 2001.

* cited by examiner

*Primary Examiner*—Carlos Lopez
(74) *Attorney, Agent, or Firm*—Ladas and Parry LLP

(57) ABSTRACT

In an automatic machine for processing tobacco articles, and having a supporting frame having a vertical front wall, at which are located a number of operating devices located along a production line for processing a succession of articles, an inner first casing is provided which can be opened and covers at least some of the operating devices, and an outer second casing is provided which can be opened, is independent of the inner first casing, and covers at least part of the inner first casing in the form of a shell; the outer second casing has a front panel facing the vertical front wall of the frame and movable, with respect to the frame, between a closed or bottom limit position, in which the front panel contacts the floor supporting the frame and is separated from the inner first casing by a distance defining the depth of a soundproofing air chamber, and an open or top limit position, in which the front panel exposes and permits access to the vertical front wall of the frame and the inner first casing.

11 Claims, 8 Drawing Sheets

AUTOMATIC MACHINE FOR PROCESSING TOBACCO ARTICLES

The present invention relates to an automatic machine for processing tobacco articles.

BACKGROUND OF THE INVENTION

An automatic machine for processing tobacco articles —e.g. a cigarette manufacturing machine, filter assembly machine, packing machine, or cellophaning machine—comprises a substantially parallelepiped-shaped supporting frame having a vertical front wall, a vertical rear wall, two vertical lateral walls, a horizontal top wall, and a horizontal bottom wall. Substantially all the operating devices of the machine (conveyors, feed devices, folding devices, gumming devices, etc.) are located at the front wall which was formerly left clear to permit fast, easy access to all the operating devices of the machine, while the other (lateral, top, bottom, and rear) walls of the frame were normally closed by removable sheet metal panels. Recent international regulations for safeguarding the health and safety of automatic machine operators, however, require mechanical barriers to prevent accidental contact with moving parts, and establish maximum machine noise levels within the workplace.

Following the entry into force of the above regulations, automatic machines for processing tobacco articles have each been equipped with a casing covering and completely enclosing the front, and which is defined by a fixed supporting structure supporting a number of rigid soundproofing panels, at least some of which are fitted to the supporting structure so as to be movable easily, when the automatic machine is off, from a closed position to an open position enabling access to the operating parts of the machine. One example of an automatic tobacco article processing machine equipped with a casing of the above type is described in Patents U.S. Pat. Nos. 4,619,277A1, 3,866,708A1 and 4,671,299A1, and others in Patents U.S. Pat. Nos. 3,851,725A1, 3,860,086A1, 3,961,874A1, 4,509,442A1 and EP0737620A1.

To further reduce the maximum noise level of automatic tobacco article processing machines within the workplace, it has also been proposed to fit the sheet metal panels closing the lateral, top, bottom and rear walls of the frame with a layer of soundproofing machine, as described in Patent Application EP1082915A1.

GB-1442751-A discloses a cigarette making machine provided with a sound proof L-shaped enclosure having at least one air inlet and at least one outlet; a suction device is provided within the enclosure to cause air circulation. Air enters through an opening located above a filter attachment device in one limb of the L and more air enters through an inlet in the other limb; a fan draws air from the machine bed and thrusts to an outlet. Air is also driven to the outlet by a fan which also operates the various suction devices of the filter attachment device.

Tests have shown the above solutions to be normally capable of reducing the noise level of currently used automatic tobacco article processing machines within the workplace to a maximum of 84 to 88 dB. Certain situations, however, call for a maximum noise level of 79 dB. Moreover, given the continual increase in operating speed (at present, the equivalent of processing 20,000 cigarettes a minute), modern automatic machines tend to make more noise, so that producing a modern automatic machine with a maximum noise level of 79 dB using the above known noise abatement solutions is extremely complicated and expensive.

EP-1422145-A1 discloses a volume element which completely encloses a cigarettes production line so that the inside can be kept temperate; in particular, different areas inside the volume element can be kept at different temperatures. A sensor can be provided to measure air humidity, pressure and/or temperature inside the volume element.

SUMMARY OF THE INVENTION

It is an object of the present invention to provide an automatic machine for processing tobacco articles, designed to eliminate the aforementioned drawbacks, and which in particular is cheap and easy to produce.

According to the present invention, there is provided an automatic machine for processing tobacco articles, as claimed in the attached Claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
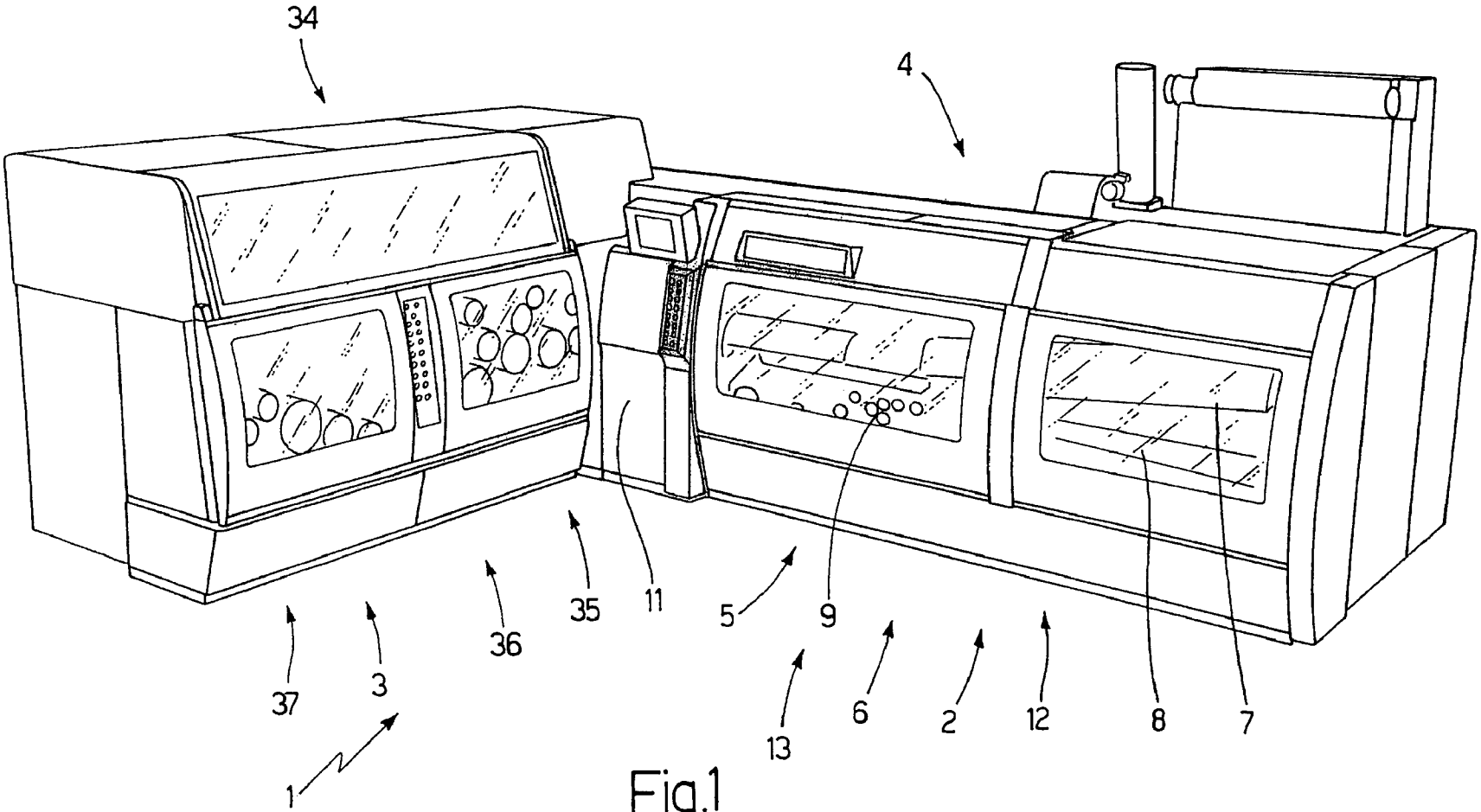
FIG. 1 shows a schematic view in perspective of an automatic machine for processing tobacco articles in accordance with the present invention.

Number 1 in FIG. 1 indicates as a whole a filter-tipped cigarette manufacturing system comprising a manufacturing machine 2 and a filter assembly machine 3.

Manufacturing machine 2 comprises a supporting frame 4 having a front wall 5; and a number of operating devices 6 for processing tobacco and located at front wall 5. More specifically, operating devices 6 comprise a tobacco hopper 7; a rod forming beam 8; an unwinding and printing station 9 for unwinding and printing a paper strip 10 (shown in detail in FIG. 10); and a rod cutting unit 11.

Manufacturing machine 2 also comprises an inner casing 12 which can be opened, is supported by the supporting frame 4, is movable between an open position and a closed position (shown in FIG. 1), covers all the operating devices 6 having moving parts, and is equipped with known safety devices (not shown in detail) for disabling operation of manufacturing machine 2 when inner casing 12 is not in the closed position. Manufacturing machine 2 also comprises an outer casing 13 which can be opened, is independent of inner casing 12, is arranged facing to and close to the inner casing 12, and covers part of inner casing 12 in the form of a shell. More specifically, outer casing 13 covers inner casing 12 at tobacco hopper 7, rod forming beam 8, and unwinding and printing station 9.

Inner casing 12 provides for reducing the noise level of manufacturing machine 2 within the workplace, and also acts as a safety device for protecting the operators of manufacturing machine 2. In fact, as stated, manufacturing machine 2 can only be operated when inner casing 12 is in the closed position. Outer casing 13, on the other hand, serves solely for reducing the noise level of manufacturing machine 2 within the workplace, and can therefore be opened at any time, even when manufacturing machine 2 is running.

Figure 2:
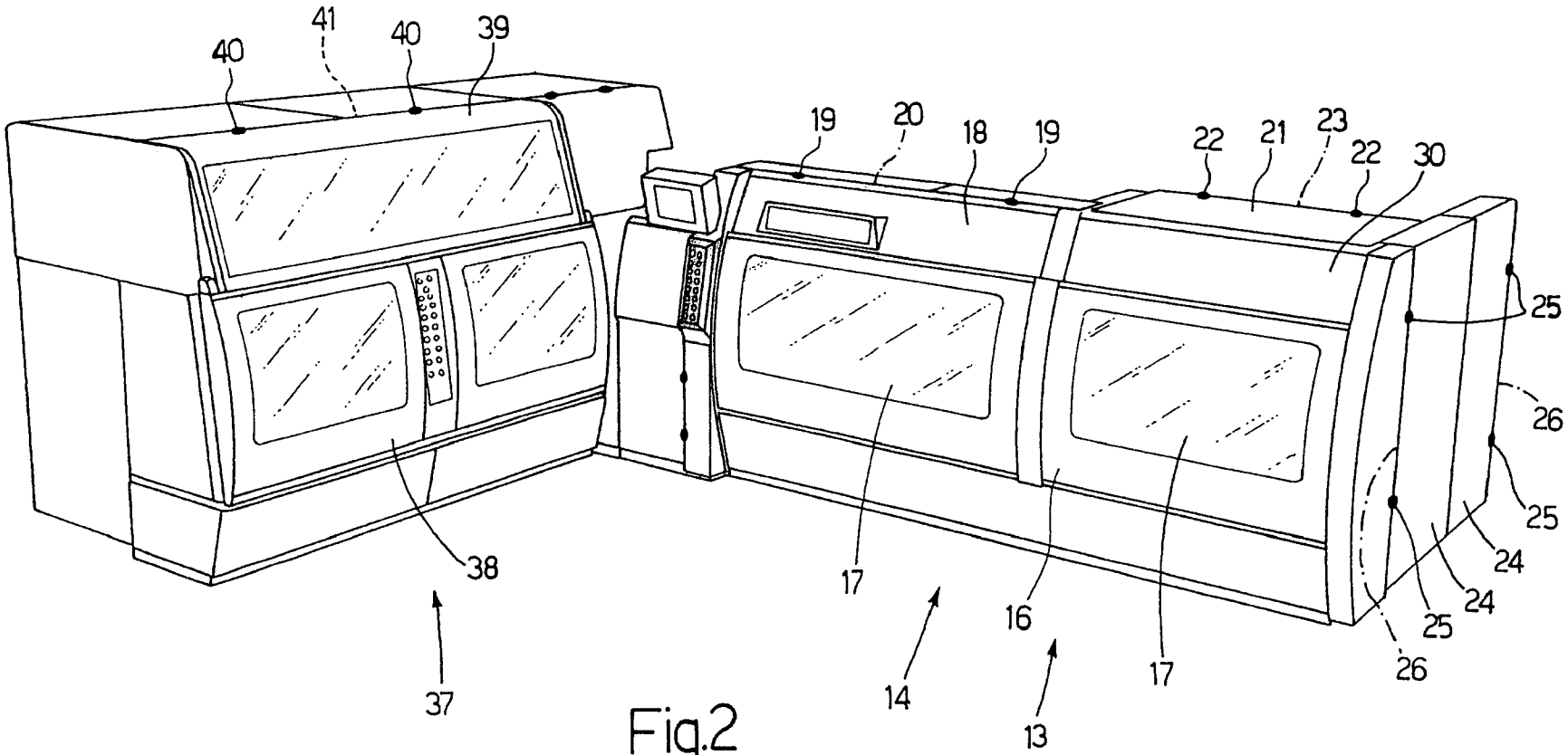
FIG. 2 shows a schematic view in perspective of an outer casing of the FIG. 1 automatic machine in a fully closed configuration.
Figure 3:
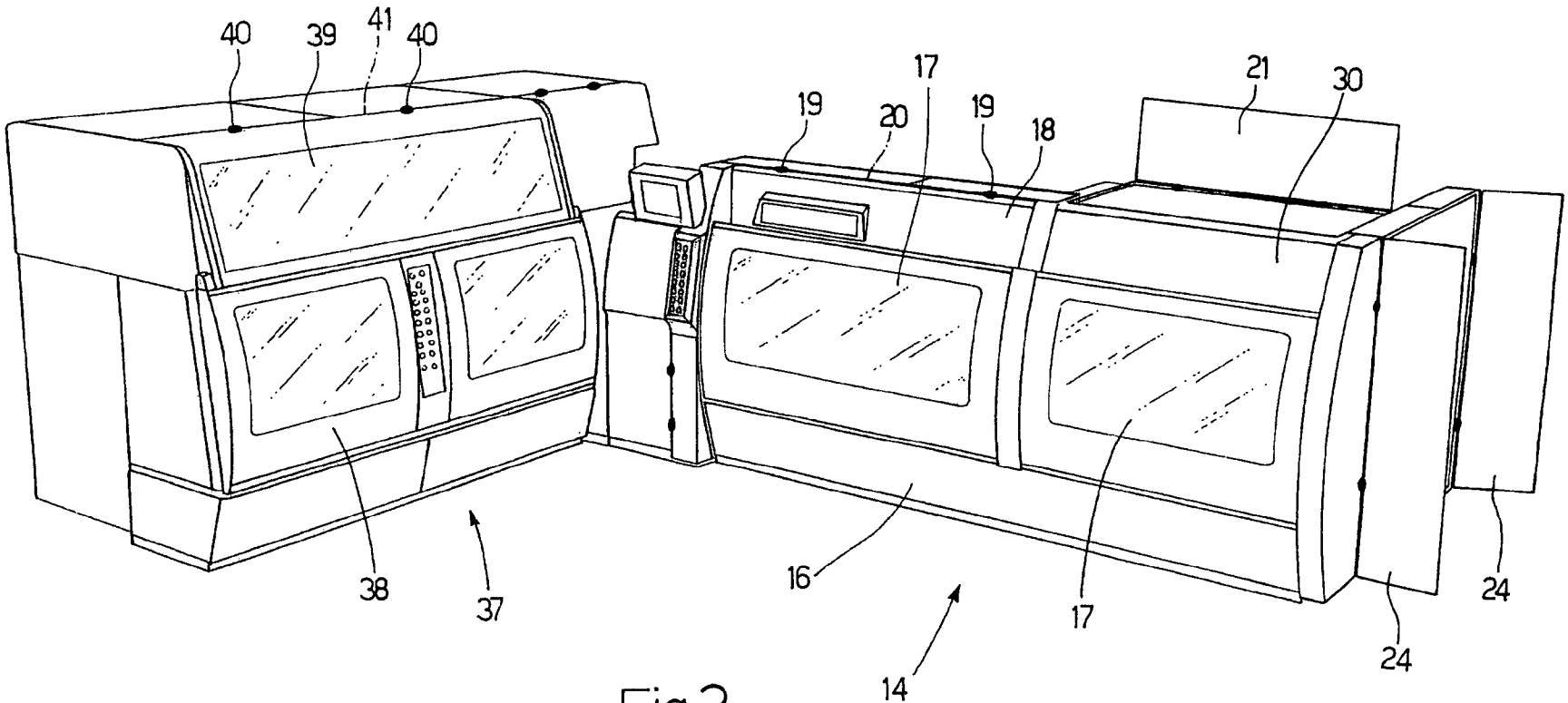
FIGS. 3 and 4 show two schematic views in perspective of the FIG. 2 outer casing in two different partly open configurations.
Figure 4:
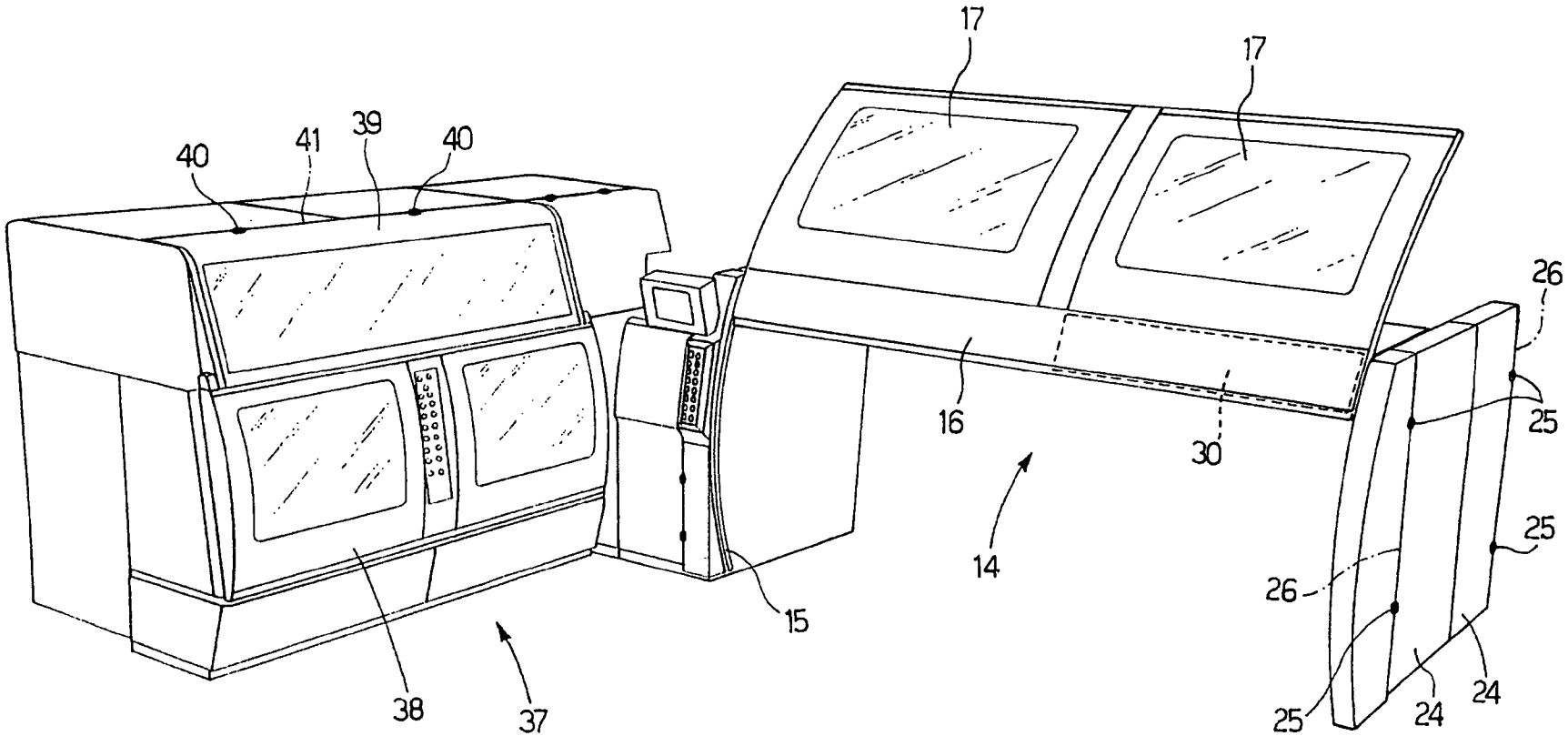

As shown in FIGS. 2, 3 and 4, outer casing 13 comprises a front panel 14 facing vertical front wall 5 of frame 4 and movable, with respect to frame 4, between a closed or bottom limit position—in which it contacts, preferably hermetically, the floor on which frame 4 stands, and is separated from inner casing 12 by a distance defining the depth of a soundproofing air chamber—and an open or top limit position exposing and permitting access to front wall 5 of frame 4 and inner casing 12.

The bottom limit position of panel 14 contacting the floor has been found to significantly reduce the otherwise fairly high noise level produced by the bottom part of manufacturing machine 2.

Panel 14 is substantially vertical, and is mounted to slide between said closed and open positions along two substantially vertical guides 15 of frame 4, located on opposite sides of panel 14. More specifically, panel 14 comprises a metal frame 16 supporting glass windows 17.

Outer casing 13 also comprises a vertical panel 18 which is higher than panel 14 when panel 14 is in the closed position, and which is mounted on hinges 19 to oscillate about a horizontal axis 20. In actual use, panel 18 is rotated about horizontal axis 20 towards manufacturing machine 2 (as shown in FIG. 3) to allow panel 14 to move from the closed to the open position.

A top portion of outer casing 13 is fitted with a horizontal panel 21 mounted on hinges 22 to oscillate about a horizontal axis 23 between a closed position (FIGS. 1 and 2) and an open position (FIG. 3); and an outer side of outer casing 13 is fitted with two vertical panels 24, each of which is mounted on hinges 25 to oscillate about a vertical axis 26 between a closed position (FIGS. 1 and 2) and an open position (FIG. 3).

Figure 5:
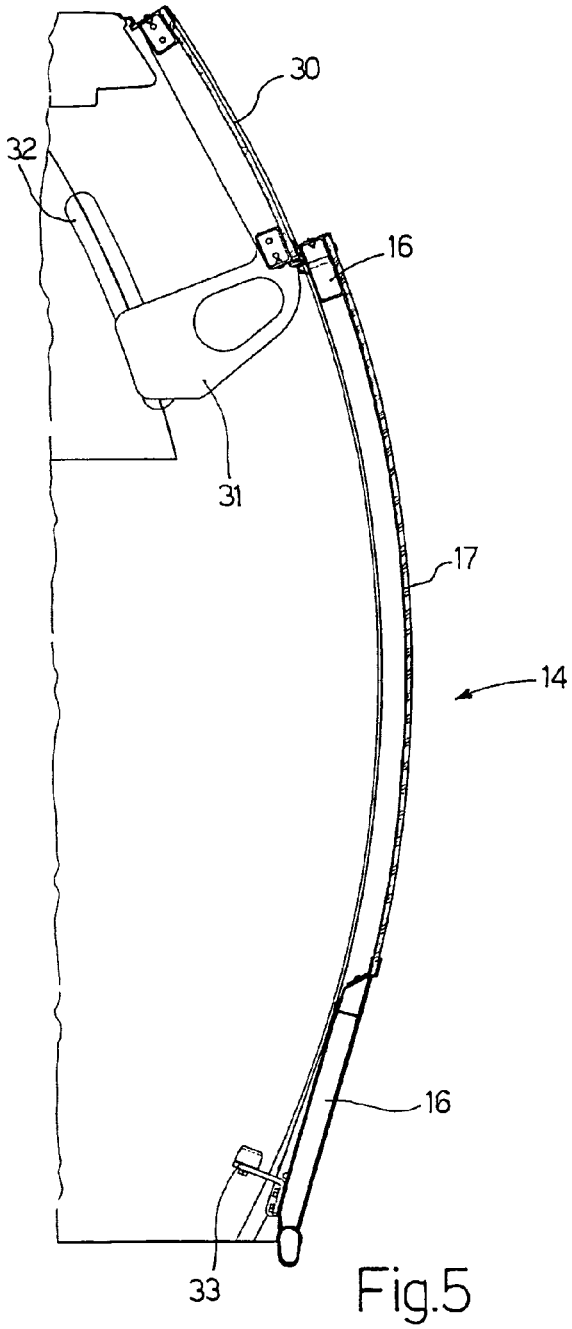
FIGS. 5 and 6 show side sections, with parts removed for clarity, of the FIG. 2 outer casing.
Figure 6:
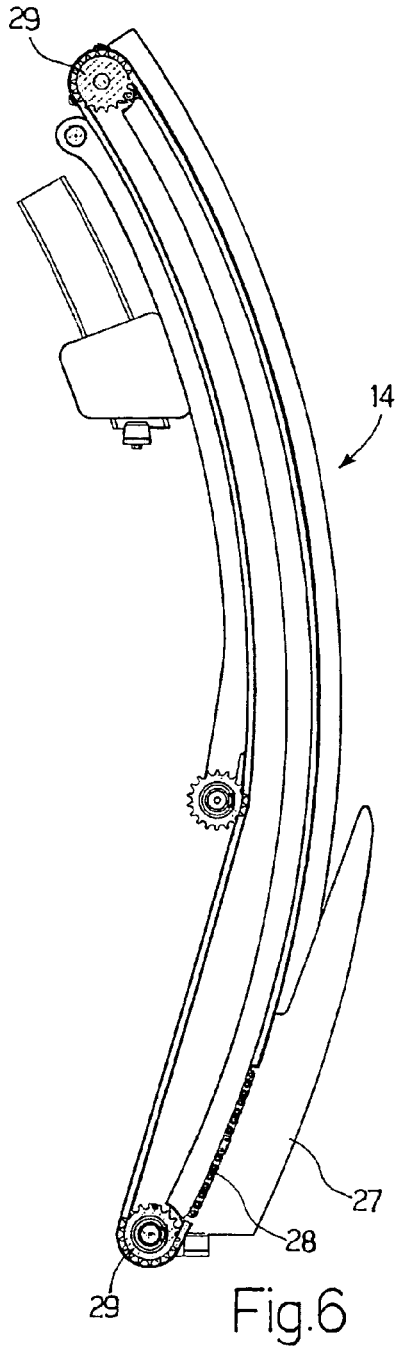

As shown in FIGS. 5 and 6, guides 15 and panel 14 are arc-shaped, and panel 14 is fitted to two slides 27 (only one shown in FIG. 6), each of which engages a respective guide 15 and is connected to a powered chain 28 looped about two end gears 29. In actual use, one of gears 29 is rotated by an electric motor (not shown) to move chain 28 and so move the respective slide together with panel 14 along the corresponding guide 15.

Panel 14 is connected to a further vertical panel 30 which is higher than panel 14 when panel 14 is the closed position, and which is mounted on two slides 31 (only one shown in FIGS. 5 and 6) which run freely along two respective vertical guides 32 (only one shown in FIGS. 5 and 6) on opposite sides of panel 30. Like guides 15 and panel 14, guides 32 and panel 30 are arc-shaped, and guides 32 are parallel to guides 15. Panel 14 has a coupling device 33 which engages panel 30 to move panel 30 along guides 32 as panel 14 moves from the closed to the open position. In other words, as it moves from the closed to the open position along guides 15, panel 14 slides over panel 30 so that coupling device 33 engages panel 30 to slide panel 30 along guides 32.

Filter assembly machine 3 comprises a supporting frame 34 having a front wall 35; and a number of operating devices 36 for processing tobacco and located at front wall 35. More specifically, operating devices 36 comprise a number of drums for feeding cigarettes between a succession of processing stations.

Filter assembly machine 3 also comprises a casing 37 which can be opened, is movable between an open position and a closed position (shown in FIG. 1), covers all the operating devices 36 having moving parts, and is equipped with known safety devices (not shown in detail) for disabling operation of filter assembly machine 3 when casing 37 is not in the closed position. Casing 37 provides for reducing the noise level of filter assembly machine 3 within the workplace, and also acts as a safety device for protecting the operators of filter assembly machine 3. In fact, as stated, filter assembly machine 3 can only be operated when casing 37 is in the closed position.

Figure 7:
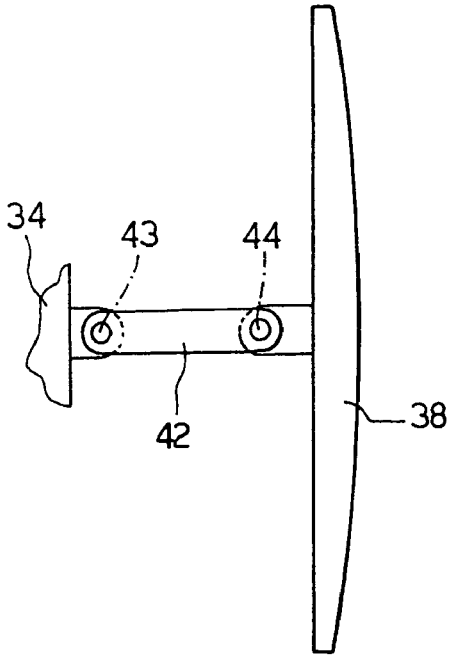
FIGS. 7, 8 and 9 show a detail of the FIG. 2 outer casing in three different operating configurations.
Figure 8:
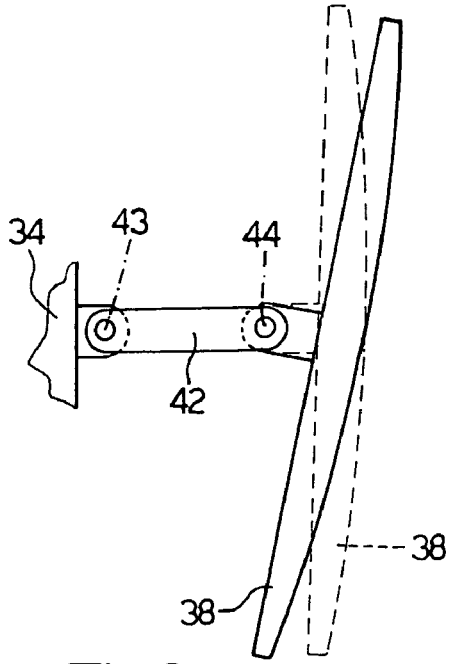
Figure 9:
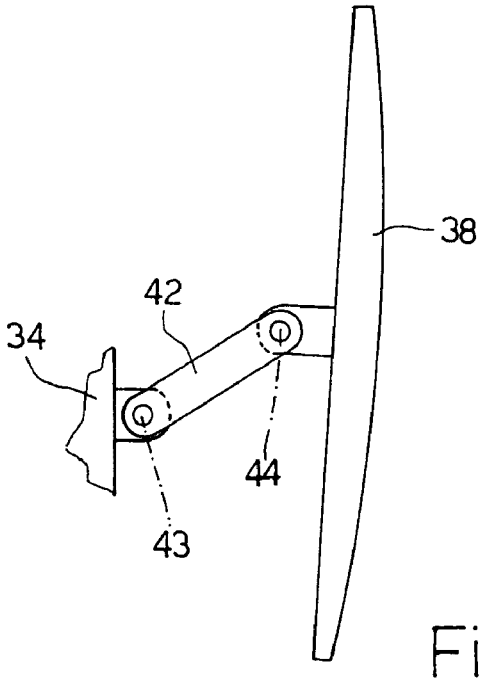

Casing 37 comprises a vertical panel 38 which can be opened; and a vertical panel 39 which can be opened, is higher than panel 38 when panel 38 is in a closed position, and is mounted on hinges 40 to oscillate about a horizontal axis 41 between an open position and a closed position (FIGS. 1-4). As shown in FIGS. 7, 8 and 9, panel 38 is supported by an arm 42 which is hinged at one end to frame 34 to rotate about a horizontal axis 43, and is hinged at the opposite end to panel 38 to rotate about a horizontal axis 44 parallel to axis 43. In actual use, to move panel 38 from the closed position (FIGS. 1-4 and FIG. 7) to the open position (FIG. 9), panel 38 is first rotated with respect to arm 42 about axis 44 (FIG. 8) to move panel 38 with respect to panel 39; arm 42 is then rotated with respect to frame 34 about axis 43, and, at the same time, panel 38 is rotated with respect to arm 42 about axis 44 (FIG. 9) to move panel 38 into the open position.

Figure 10:
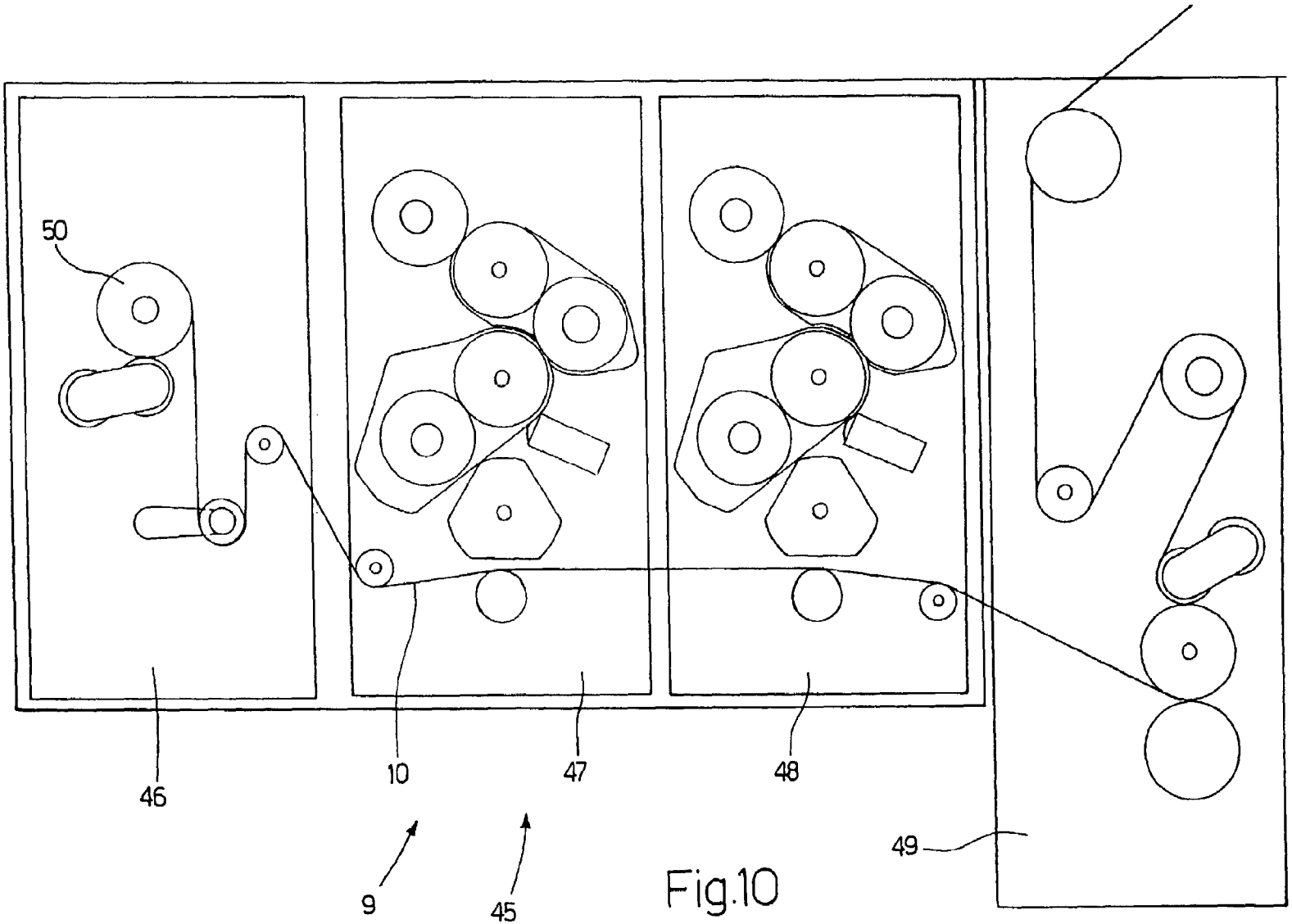
FIG. 10 shows a front view of an unwinding and printing station of the automatic machine in FIG. 1.

As shown in FIG. 10, unwinding and printing station 9 comprises four side by side operating units 45 comprising an unwinding unit 46, a printing unit 47, a printing unit 48, and a feed unit 49. Unwinding unit 46 unwinds strip 10 in controlled manner off a reel 50; printing units 47 and 48 continuously print a series of marks on one surface of strip 10 using inks of two different colours (one for each printing unit 47, 48); and feed unit 49 feeds the strip to rod forming beam 8 at a controlled tension.

Operating units 45 are preferably modular and the same size. In particular, in the FIG. 10 embodiment, unwinding unit 46 and printing units 47 and 48 are modular and the same size.

In an alternative embodiment not shown, unwinding unit 46 comprises a further printing unit for continuously printing a series of marks on one surface of strip 10 using ink of a third colour other than the two colours used on printing units 47 and 48.

Figure 11:
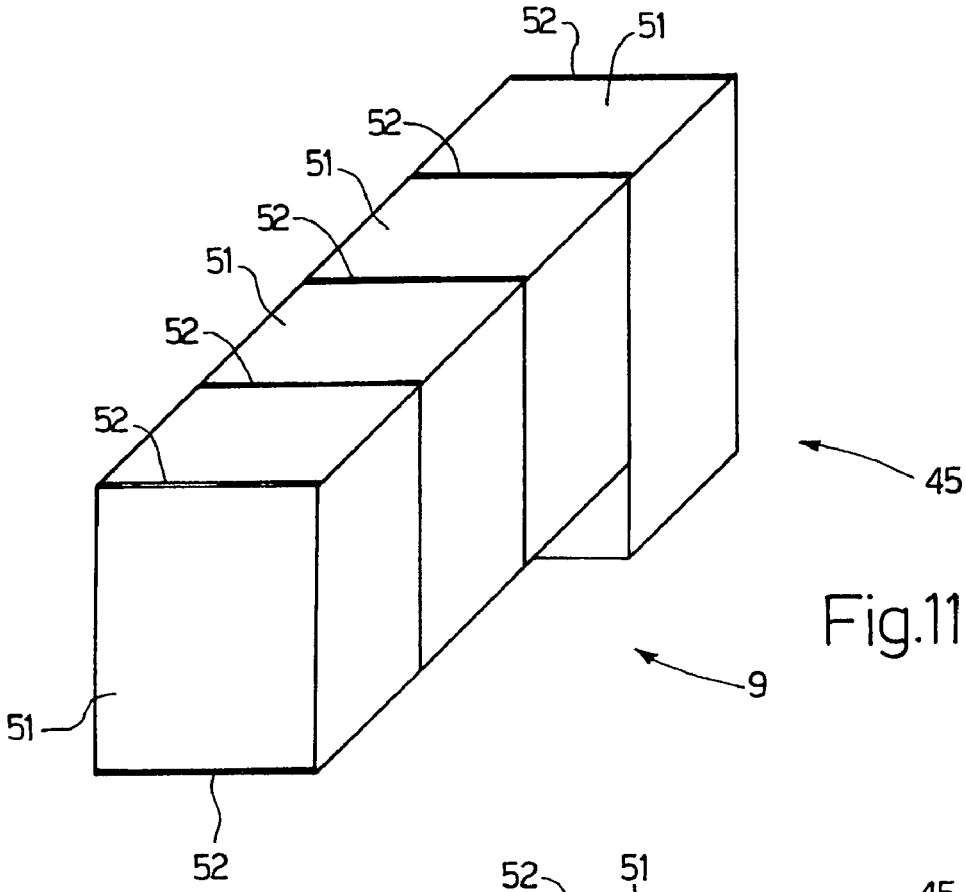
FIGS. 11 and 12 show schematic views in perspective of the unwinding and printing station in two different operating configurations.
Figure 12:
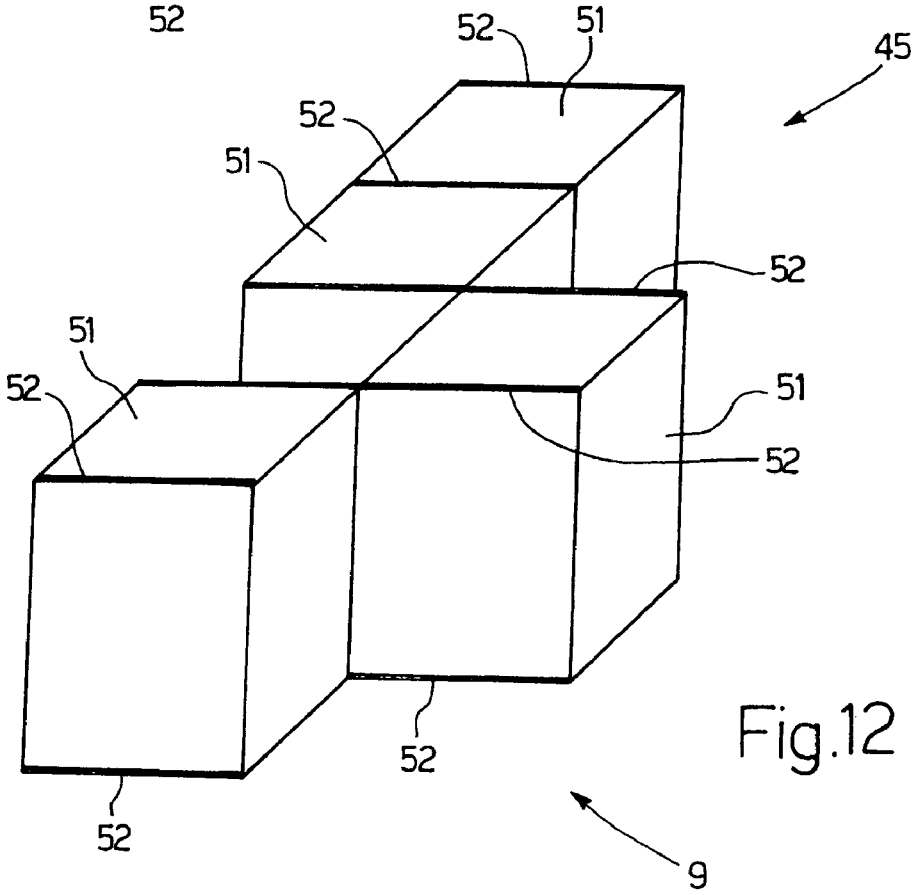

As shown in FIGS. 11 and 12, each operating unit 45 is fitted to a respective frame 51 which is mounted on respective telescopic horizontal guides 52 integral with frame 4 of manufacturing machine 2, so as to move between a work position (FIG. 11) and a maintenance position (FIG. 12) in which operating unit 45 is extracted completely from frame 4.

The invention claimed is:

1. An automatic machine for processing tobacco articles, the machine comprising:

a supporting frame (4) having a front wall (5);

a number of operating devices (6) located at the front wall (5) and for processing a succession of articles;

an inner first casing (12) which is supported by the supporting frame (4), can be opened, covers all the operating devices (6) having moving parts, and acts as a safety device for protecting operators of the automatic machine (2);

safety means for disabling operation of the machine when the inner first casing (12) is not in a closed position;

an outer second casing (13) which can be opened, is independent of the inner first casing (12), is arranged facing to and close to the inner first casing (12), is independent of the inner first casing (12), covers at least part of the inner first casing (12), is separated from the inner first casing (12) by a distance defining the depth of a soundproofing air chamber, and is movable between a closed position and an open position regardless of the operating condition of the machine.

2. A machine as claimed in claim 1, wherein the outer second casing (13) has actuating means for moving the outer second casing (13) between the closed position and the open position, and which can be activated regardless of the operating condition of the machine.

3. A machine as claimed in claim 1, wherein the outer second casing (13) comprises a front panel (14) facing the vertical front wall (5) of the frame (4) and movable, with respect to the frame (4), between a closed or bottom limit position, in which the front panel (14) contacts a floor supporting the frame (4) and is separated from the inner first casing (12) by a distance defining the depth of a soundproofing air chamber, and an open or top limit position, in which the front panel (14) exposes and permits access to the front wall (5) of the frame (4) and the inner first casing (12).

4. A machine as claimed in claim 1, wherein the outer second casing (13) comprises a first panel (14) which is substantially vertical and mounted to slide along two vertical first guides (15), located on opposite sides of the first panel (14), to move between a closed position and an open position.

5. A machine as claimed in claim 4, wherein the first guides (15) and the first panel (14) are arc-shaped.

6. A machine as claimed in claim 4, wherein the first panel (14) is mounted on two first slides (27), each of which engages a respective first guide (15) and is connected to an endless powered transmission member (28).

7. A machine as claimed in claim 4, wherein the outer second casing (13) comprises a vertical second panel (30) which is higher than the first panel (14) when the first panel (14) is in the closed position, and which slides freely along two vertical second guides (32) located on opposite sides of the second panel (30).

8. A machine as claimed in claim 7, wherein the second guides (32) are parallel to the first guides (15); the first panel (14) being movable along the first guides (15), and having a coupling device (33) which engages the second panel (30) to move the second panel (30) along the second guides (32) as the first panel (14) moves from the closed position to the open position.

9. machine as claimed in claim 3, wherein the outer second casing (13) comprises a vertical third panel (18) which is higher than the first panel (14) when the first panel (14) is in the closed position, and which is mounted to rotate about a horizontal axis (20); the third panel (18) being rotated about the horizontal axis to allow the first panel (14) to move from the closed position to the open position.

10. A machine as claimed in claim 3, wherein the first panel (14) comprises a metal frame (16) supporting two glass windows (17).

11. A machine as claimed in claim 3, wherein the machine is a cigarette manufacturing machine (2) comprising a tobacco hopper (7), a rod forming beam (8), an unwinding and printing station (9) for unwinding and printing a paper strip (10), and a rod cutting unit (11); the first panel (14) covering the region of the hopper (7), rod-forming beam (8), and unwinding and printing station (9).

* * * * *

UNITED STATES PATENT AND TRADEMARK OFFICE

CERTIFICATE OF CORRECTION

PATENT NO. : 7,509,960 B2
APPLICATION NO. : 10/991330
DATED : March 31, 2009
INVENTOR(S) : Fiorenzo Draghetti et al.

It is certified that error appears in the above-identified patent and that said Letters Patent is hereby corrected as shown below:

On title page, (73), Assignee: before "D" insert -- G. --

Signed and Sealed this

Fourteenth Day of December, 2010

David J. Kappos

David J. Kappos
*Director of the United States Patent and Trademark Office*